US010843489B2

(12) United States Patent
Kato et al.

(10) Patent No.: US 10,843,489 B2
(45) Date of Patent: Nov. 24, 2020

(54) PRINTING DEVICE HAVING SHEET SUPPORT PORTION MOVABLE TO RANGE EXCEEDING SHEET WIDTH AND ALSO EXCEEDING RANGE OF SHEET WIDTH DETECTION

(71) Applicant: BROTHER KOGYO KABUSHIKI KAISHA, Nagoya (JP)

(72) Inventors: Nobuo Kato, Nagoya (JP); Masashi Tanizaki, Kuwana (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/293,620

(22) Filed: Mar. 5, 2019

(65) Prior Publication Data

US 2019/0366737 A1 Dec. 5, 2019

(30) Foreign Application Priority Data

May 30, 2018 (JP) ..... 2018-103935

(51) Int. Cl.

| | |
|---|---|
| ***B41J 11/42*** | (2006.01) |
| ***B41J 11/00*** | (2006.01) |
| ***B41J 15/04*** | (2006.01) |
| ***B41J 11/04*** | (2006.01) |
| ***B41J 2/325*** | (2006.01) |
| ***B41J 3/407*** | (2006.01) |

(52) U.S. Cl.

CPC ..... *B41J 11/003* (2013.01); *B41J 2/325* (2013.01); *B41J 3/4075* (2013.01); *B41J 11/04* (2013.01); *B41J 15/042* (2013.01)

(58) Field of Classification Search

None

See application file for complete search history.

(56) References Cited

U.S. PATENT DOCUMENTS 6,017,159 A * 1/2000 Tse ..... B41J 35/28 400/208
2004/0189756 A1* 9/2004 Ikezaki ..... B41J 2/17509 347/86
2006/0221165 A1* 10/2006 Kato ..... B41J 11/003 347/104

FOREIGN PATENT DOCUMENTS

JP 7-223758 A 8/1995

* cited by examiner

*Primary Examiner* — Erica S Lin
(74) *Attorney, Agent, or Firm* — Kenealy Vaidya LLP

(57) ABSTRACT

A printing device includes a first support portion, a second support portion movable in a moving direction of the second support portion toward and away from the first support portion, a movable probe movably supported by a detector, and a permission mechanism. The movable range consists of a first range and a second range. The permission mechanism is configured to permit the movable probe to move in accordance with the movement of the second support portion in the separating/approaching direction relative to the first support portion in a case where the movement of the second support portion is within the first range, and is also configured to prevent the movable probe from moving irrespective of further movement of the second support portion relative to the first support portion in a case where the movement of the second support portion is within the second range.

11 Claims, 10 Drawing Sheets

PRINTING DEVICE HAVING SHEET SUPPORT PORTION MOVABLE TO RANGE EXCEEDING SHEET WIDTH AND ALSO EXCEEDING RANGE OF SHEET WIDTH DETECTION

CROSS REFERENCE TO RELATED APPLICATION

This application claims priority from Japanese Patent Application No. 2018-103935 filed May 30, 2018. The entire content of the priority application is incorporated herein by reference.

TECHNICAL FIELD

The present disclosure relates to a printing device.

BACKGROUND

There has been conventionally known a sheet width detection device including a pair of sheet width regulation members and a variable resistor as described in Japanese Patent Application Publication No. Hei 07-223758. At least one of the pair of sheet width regulation members is movable. The movable member is provided with an abutment rib, a shaft, a lever, and a tension coil spring. The shaft pivotally movably supports the lever. The variable resistor slidably supports a movable probe which moves in interlocking relation to the movement of the at least one of the pair of sheet width regulation members. The movable probe is initially interposed between the rib and the lever. The tension coil spring urges the lever to nip the movable probe between the rib and the lever. A user adjusts an interval between the pair of sheet width regulation members so as to place the sheet therebetween. In a case where a moving length of the movable member is greater than a maximum movable length of the movable probe supported by the variable resistor, the lever is pivotally moved against the urging force of the tension coil spring, causing detachment of the rib from the movable probe so that the movable member can solely move. The sheet width detection device detects a width of the sheet placed between the pair of sheet width regulation members on a basis of a change in a resistance value in response to position of the movable probe.

SUMMARY

In a case where a rolled printing medium is to be placed between the pair of sheet width regulation members of the above-mentioned sheet width detection device, an interval of the pair of sheet width regulation members is almost equal to a sheet width, making it difficult to place the rolled printing medium.

In view of the foregoing, it is an object of the disclosure to provide a printing device provided with a sheet width detector and capable of facilitating setting of a rolled printing medium between a pair of support portions which detachably supports the rolled printing medium.

In order to attain the above and other objects, according to one aspect, the disclosure provides a printing device including a first support portion, a second support portion, a movable probe, a detector, and a permission mechanism. The second support portion detachably supports a rolled printing medium in cooperation with the first support portion and is configured to be movable in a movable range in a separating/approaching direction which is a moving direction of the second support portion toward and away from the first support portion. The movable range consists of a first range and a second range following the first range. An interval between the first support portion and the second support portion is not more than a predetermined amount in the first range. The interval between the first support portion and the second support portion is greater than the predetermined amount in the second range. The movable probe is movable in the separating/approaching direction. The detector positioned is at a fixed position, supports the movable probe, and is configured to detect a position of the movable probe in the separating/approaching direction. The detector provids a detectable range ranging within the first range. The permission mechanism is configured to permit the movable probe to move in accordance with the movement of the second support portion in the separating/approaching direction relative to the first support portion in a case where the movement of the second support portion is within the first range. The permission mechanism is also configured to prevent the movable probe from moving irrespective of further movement of the second support portion relative to the first support portion in a case where the movement of the second support portion in the separating/approaching direction is within the second range.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

Figure 1:
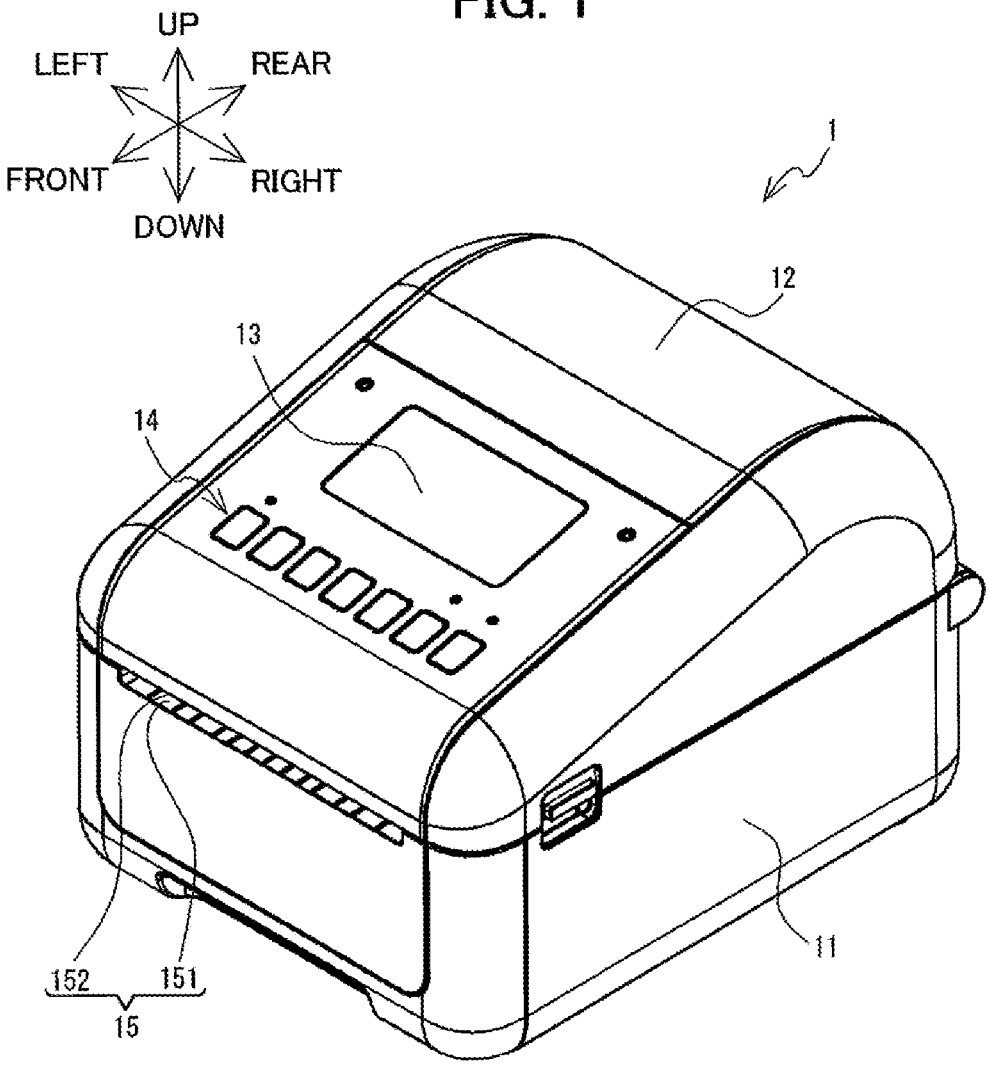
FIG. 1 is a perspective view of a printing device according to one embodiment in a closed state of a cover 12 relative to a main body portion 11.

A printing device 1 according to one embodiment will be described with reference to FIG. 1 through 10. Regarding orientation of the printing device 1 illustrated in FIG. 1, a diagonally lower rightward direction, a diagonally upper leftward direction, a diagonally upper rightward direction, a diagonally lower leftward direction, an upward direction, and a downward direction those in FIG. 1 will be referred to as a rightward direction, a leftward direction, a rearward direction, a frontward direction, an upward direction, and a downward direction, respectively.

1. Overall Structure of Printing Device 1

The printing device 1 is configured to receive printing data from an external device (not illustrated) such as a personal computer terminal and to perform printing on a printing medium on a basis of the printing data. A heat sensitive label is one of examples of a component of the printing medium. As illustrated in the FIG. 1 through FIG. 3, the printing device 1 includes a main body portion 11, a cover 12, and an ejection portion 15. The main body portion 11 and the cover 12 are formed of a resin material. The ejection portion 15 is in a form of a slit through which a tape (described later) on which an image is recorded inside the printing device 1 is ejectable to an outside of the printing device 1. The ejection portion 15 extends in a leftward/rightward direction, and is constituted by a lower ejection portion 151 positioned at a front side of the main body portion 11 and an upper ejection portion 152 positioned at a front side of the cover 12.

The main body portion 11 has a generally rectangular parallelepiped shape. The main body portion 11 constitutes a lower portion of the printing device 1, and includes a main body cover 20, an accommodating portion 21, a platen roller 22, a roll support mechanism 23, and detector 9 (see FIG. 5). As illustrated in FIGS. 3, 4A, 4B, and 7, the main body cover 20 is a plate-like member and has a rear portion formed in an arcuate shape protruding downward. The main body cover 20 has guide slots 25 and 26, a recessed portion 27, the lower ejection portion 151, and a regulation member 39.

The guide slots 25 and 26 are through-holes having a rectangular shape that extends in the leftward/rightward direction. The guide slots 25 and 26 are positioned between the recessed portion 27 and a lowermost portion of the main body cover 20 in the frontward/rearward direction. The guide slot 25 allows a connecting portion 34 (FIGS. 3 and 5) of a first support portion 3 to extend therethrough, and the guide slot 26 allows a connecting portion 44 (FIGS. 3 and 5) of a second support portion (described later) to extend therethrough. The guide slot 25 is positioned generally at a right half portion of the main body cover 20, but a left end of the guide slot 25 is positioned leftward of a center in the leftward/rightward direction of the main body portion 20. The guide slot 26 is positioned generally at a left half portion of the main body cover 20, but a right end of the guide slot 26 is positioned rightward of the center in the leftward/rightward direction of the main body portion 20.

The left end portion of the guide slot 25 and the right end portion of the guide slot 26 are overlapped with each other in the frontward/rearward direction at a center portion in leftward/rightward direction of the printing device 1. The guide slot 26 is positioned rearward of the guide slot 25. The recessed portion 27 is recessed downward and extends in the leftward/rightward direction. The recessed portion 27 is positioned frontward of the guide slots 25 and 26 and rearward of a platen roller 22 (described later). The lower ejection portion 151 constitutes a lower portion of the ejection portion 15 positioned at a front portion of the main body cover 20. The regulation portion 39 is a convex portion protruding downward and is disposed at a position facing a rod member 10 (described later).

Figure 2:
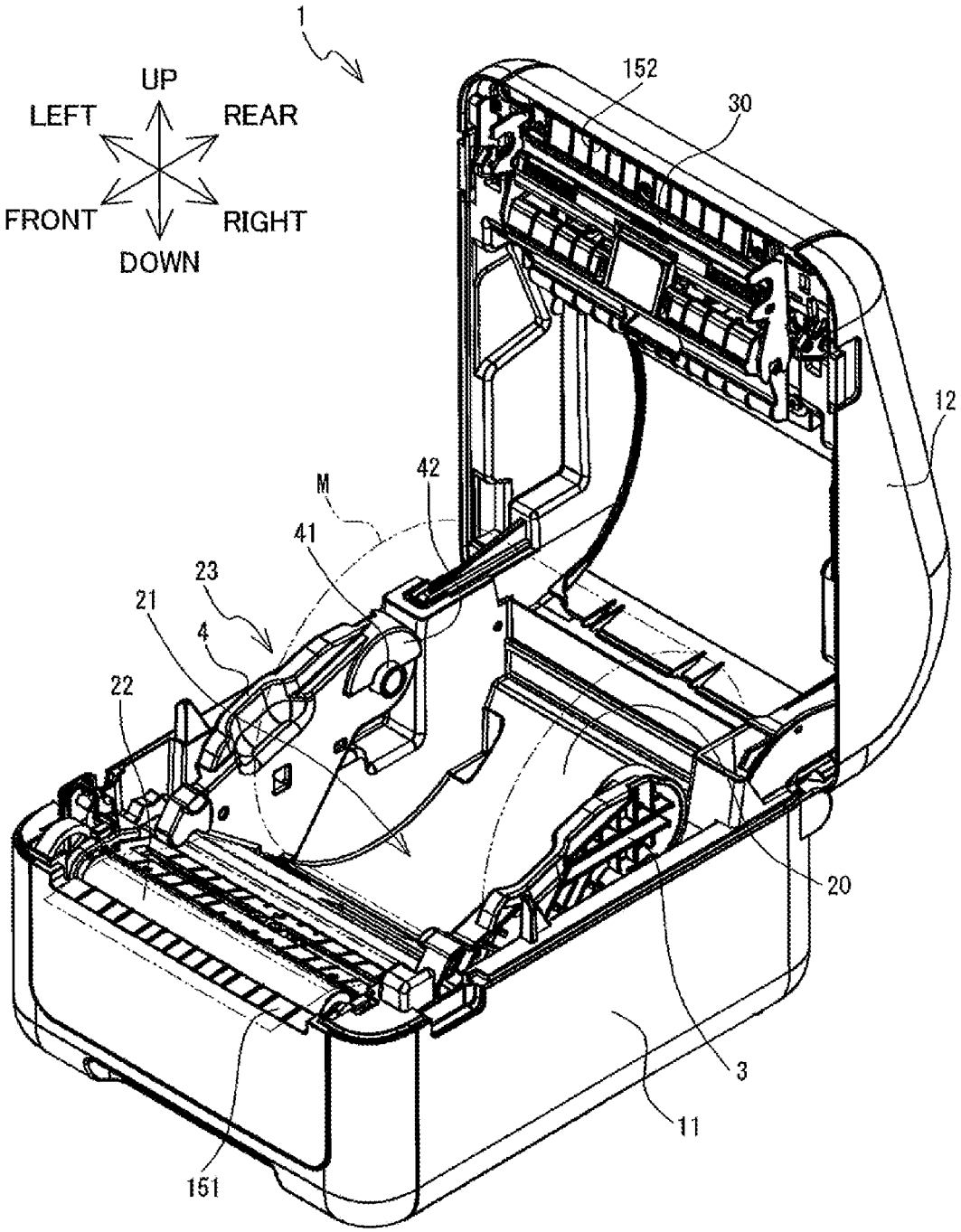
FIG. 2 is a perspective view of the printing device according to the embodiment in an opened state of the cover 12 relative to the main body portion 11.

As illustrated in FIG. 2, the accommodating portion 21 is an interior space of the printing device 1 and defined by the main body cover 20. The accommodating portion is configured to accommodate therein a sheet roll M so that a core of the sheet roll M extends in the leftward/rightward direction. The sheet roll M is constituted by the core having a hollow cylindrical shape and a sheet roll wound over the core. The sheet roll includes a base sheet and the heat sensitive label affixed to the base sheet. In the following description, a combination of the base sheet and the heat sensitive label affixed thereto will be referred to as the "tape". The tape is an example of the printing medium.

The platen roller 22 is cylindrical in shape and is configured to convey the tape. The platen roller extends in a longitudinal direction (leftward/rightward direction) of the ejection portion 15. The roll support mechanism 23 is configured to detachably support the sheet roll M. Details of the roll support mechanism 23 will be described later.

Figure 5:
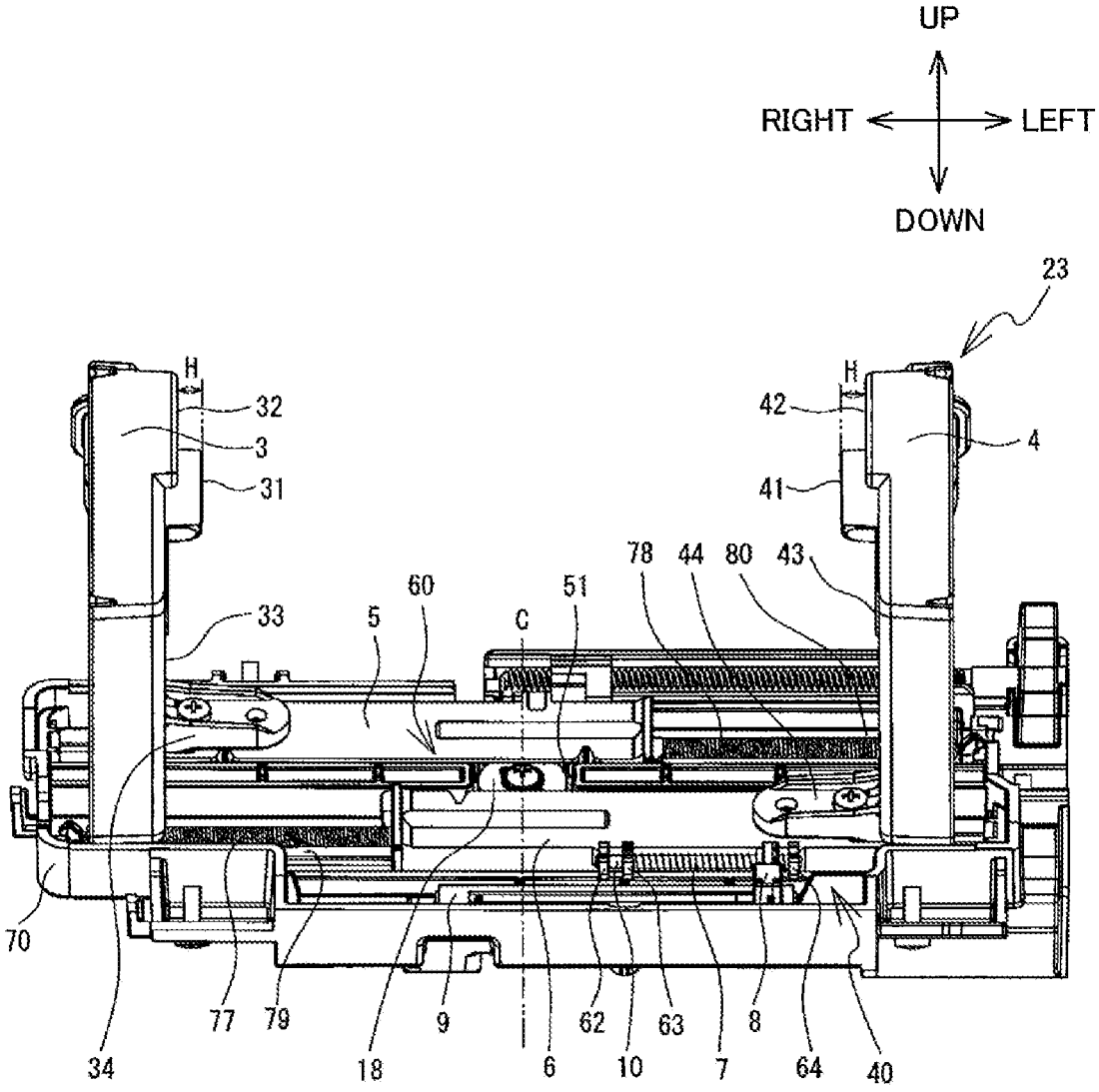
FIG. 5 is a rear side view illustrating a roll support mechanism 23 in the printing device according to the embodiment.

The detector 9 is illustrated in FIG. 5. The detector 9 is configured to detect a width of the sheet roll M supported by the roll support mechanism 23. The width of the sheet roll M is a length in an extending direction (the leftward/rightward direction) of the core of the sheet roll M. The detector 9 movably supports a movable probe 8 (described later) movable in a moving direction (the leftward/rightward direction, or separating/approaching direction described later) to detect a position of the movable probe 8 in the moving direction.

Figure 4A:
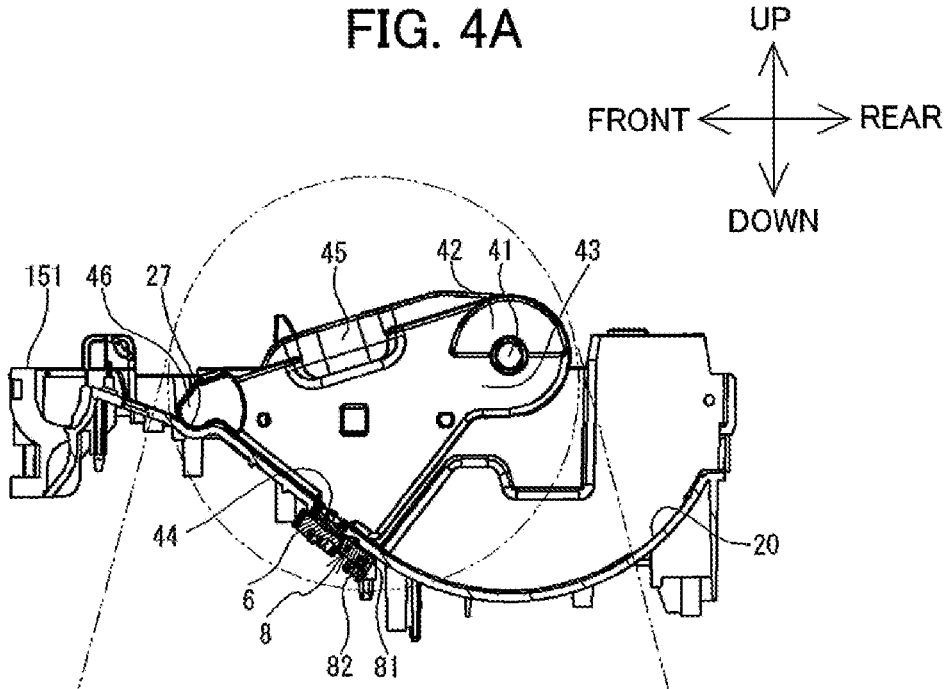
FIG. 4A is a cross-sectional view of the printing device taken along a line A-A in FIG. 3 as viewed in an arrow direction.
Figure 4B:
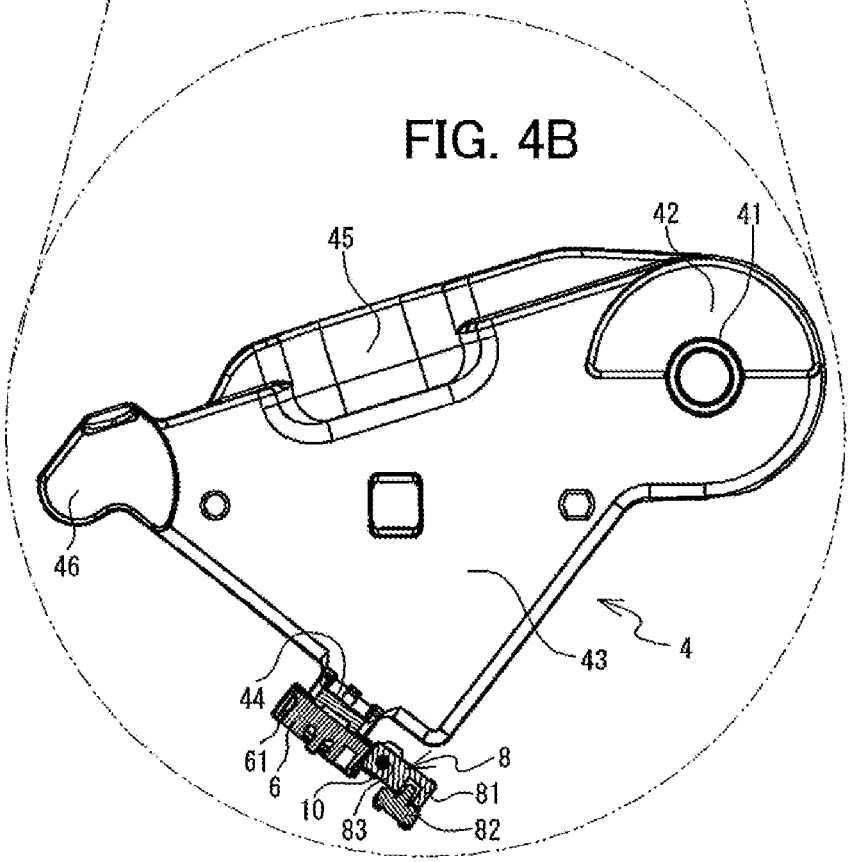
FIG. 4B is an enlarged cross-sectional view of a second support portion 4 in the printing device according to the embodiment.

As illustrated in FIG. 4B, the movable probe 8 is provided with an intervening member 81 and a movable body 82. The intervening member 81 has a front portion formed with a through-hole 83 extending in the moving direction. The intervening member 81 has a lower surface formed with a concave portion recessed upward. The movable body 82 has a convex portion protruding upward which is accommodated in the concave portion of the intervening member 81. The intervening member 81 and the movable body 82 integrally move in the moving direction.

Figure 7:
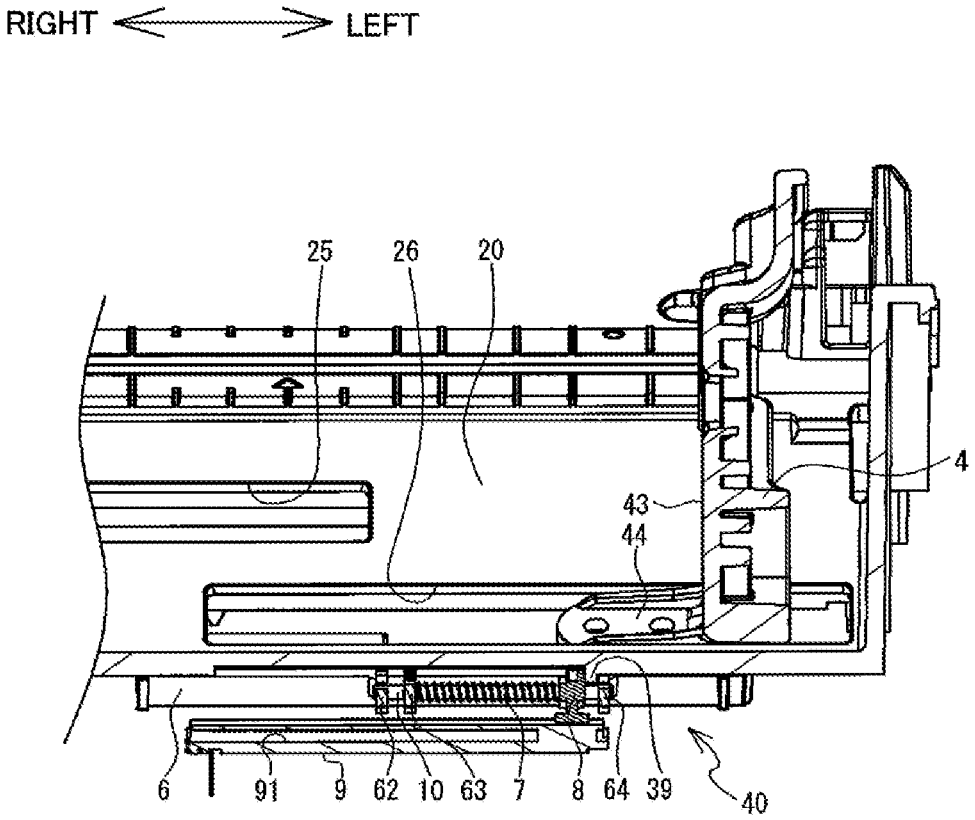
FIG. 7 is a cross-sectional view of the printing device taken along a line B-B in FIG. 3 as viewed in another arrow direction.
Figure 8:
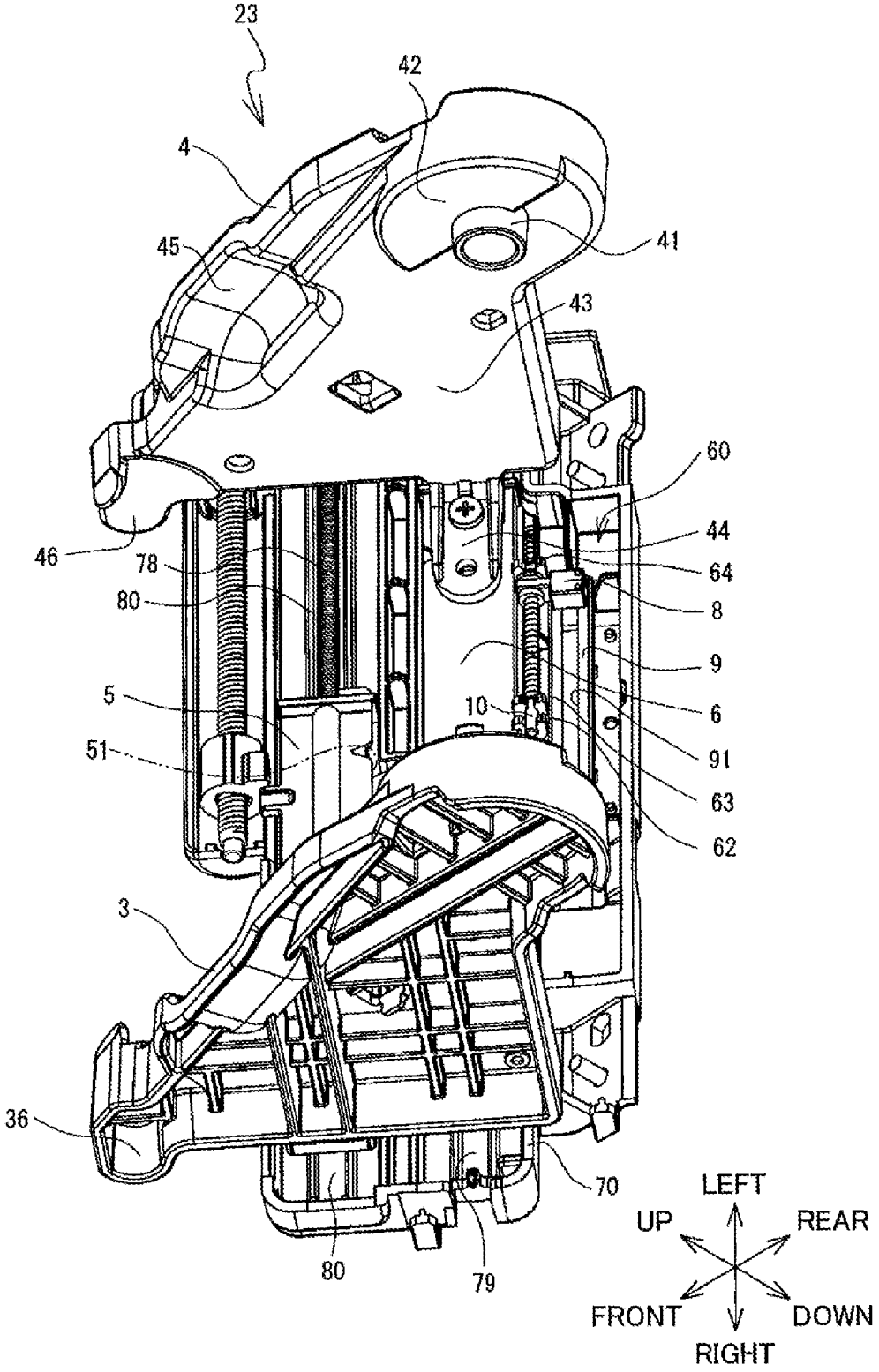
FIG. 8 is a perspective view illustrating the roll support mechanism 23.

The detector 9 is a well-known variable resistor whose longitudinal direction is the moving direction. The detector 9 is formed with a guide groove 91 extending in the moving direction as illustrated in FIG. 7. The detector 9 movably supports the movable body 82 of the movable probe 8 along the guide groove 91. The printing device 1 has an electric circuit board (not illustrated) in the main body portion 11 at a position downward of the main body cover 20. The electric circuit board is configured to control the printing device 1.

The cover 12 is pivotally movable between a closed position and an open position about an axis extending in the leftward/rightward direction and positioned at an upper-rear portion of the main body portion 11. As illustrated in FIG. 1, in the closed state of the cover 12, an upper surface of the cover 12 slopes downward toward a front end of the main body portion 11. The printing device 1 is provided with a display 13 and an operating portion 14 on the upper surface of the cover 12 in the closed state of the cover 12. The operating portion 14 functions as an interface for inputting various instructions to the printing device 1. As illustrated in FIG. 2, the cover 12 accommodates therein a thermal head 30 extending in the leftward/rightward direction. The thermal head 30 includes a plurality of heating elements aligned with each other in the leftward/rightward direction. The thermal head 30 is controlled by the above-mentioned electric circuit board and is configured to print a character image on the heat sensitive label upon heating. The cover 12 includes the upper ejection portion 152, which is an upper portion of the ejection portion 15 provided at a front end portion of the cover 12.

2. Structure of Roll Support Mechanism 23

Details of the roll support mechanism 23 will be described with reference to FIGS. 2 through 9. The roll support mechanism 23 includes a first support portion 3, a second support portion 4, guide members 5 and 6, a permission mechanism 40, and an interlocking mechanism 60. The first support portion 3 and the second support portion 4 form a generally bilaterally symmetrical appearance. Hereinafter, a moving direction of the second support portion 4 toward and away from first support portion 3 will be referred to as a "separating/approaching direction" (leftward/rightward direction). The direction from the second support portion 4 to the first support portion 3 will be referred to as approaching direction (rightward direction). The direction from the first support portion 3 to the second support portion 4 will be referred to as separating direction (leftward direction).

Figure 6:
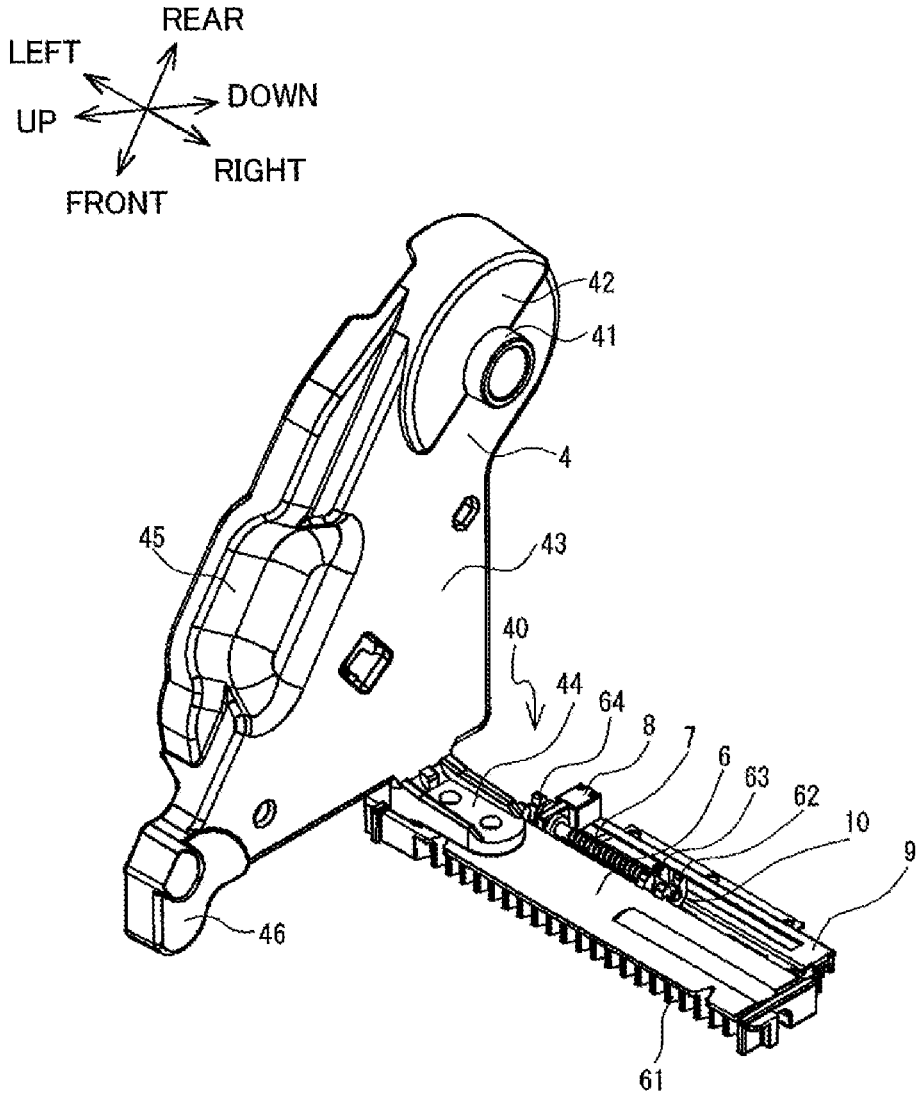
FIG. 6 is a perspective view illustrating a second support portion 4 and a guide member 6 in the printing device according to the embodiment.

As illustrated in FIG. 6. the second support portion 4 is a plate-like member having a generally right-angled triangular shape in a side view. The second support portion 4 is configured to be movable in the separating/approaching direction for detachably supporting the roll M in cooperation with the first support portion 3. The movable probe 8 is movable in the separating/approaching direction upon movement of the second support portion 4 in the separating/approaching direction.

The second support portion 4 includes a protrusion 41, a sector portion 42, a facing surface 43, a connecting portion 44, a concave portion 45, and a convex portion 46. The facing surface 43 faces rightward facing the first support portion 3. The protrusion 41 having a truncated-cone shape protrudes rightward toward the first support portion 3 from a center of a rear portion of the facing surface 43. The protrusion 41 has a protruding length H (see FIG. 6) from the sector portion 42.

The sector portion 42 is semicircular shaped in a right-side view, and protrudes in the approaching direction (rightward) from the facing surface 43 at a position generally upward of a radial center of the protrusion 41 in the upward/downward direction. The sector portion 42 has an imaginary center generally coincident with the radial center. A length of the protrusion 41 protruding rightward from the facing surface 43 is greater than a length of the sector portion 42 protruding rightward from the facing surface 43.

The connecting portion 44 having a plate-like shape extends in the approaching direction (rightward) from a lower-end portion of the facing surface 43. The connecting portion 44 has through-holes extending in the upward/rearward direction. The connecting porting 44 of the second support portion 4 is fixed to a guide member 6 (described later) by screws extending through the through-holes of the connecting portion 44, while the connecting portion 44 is inserted in the guide slot 26 of the main body cover 20.

The concave portion 45 is positioned in the vicinity of a hypotenuse of the right angled triangular shaped second support portion 4, and is recessed in the separating direction (leftward). The convex portion 46 protrudes downward from a front-end portion of the second support portion 4. The convex portion 46 is fitted with the recessed portion 27 of the main body cover 20. Movement of the second support portion 4 in the leftward/rightward direction is guided by the guide slot 26 and the recessed portion 27.

Figure 3:
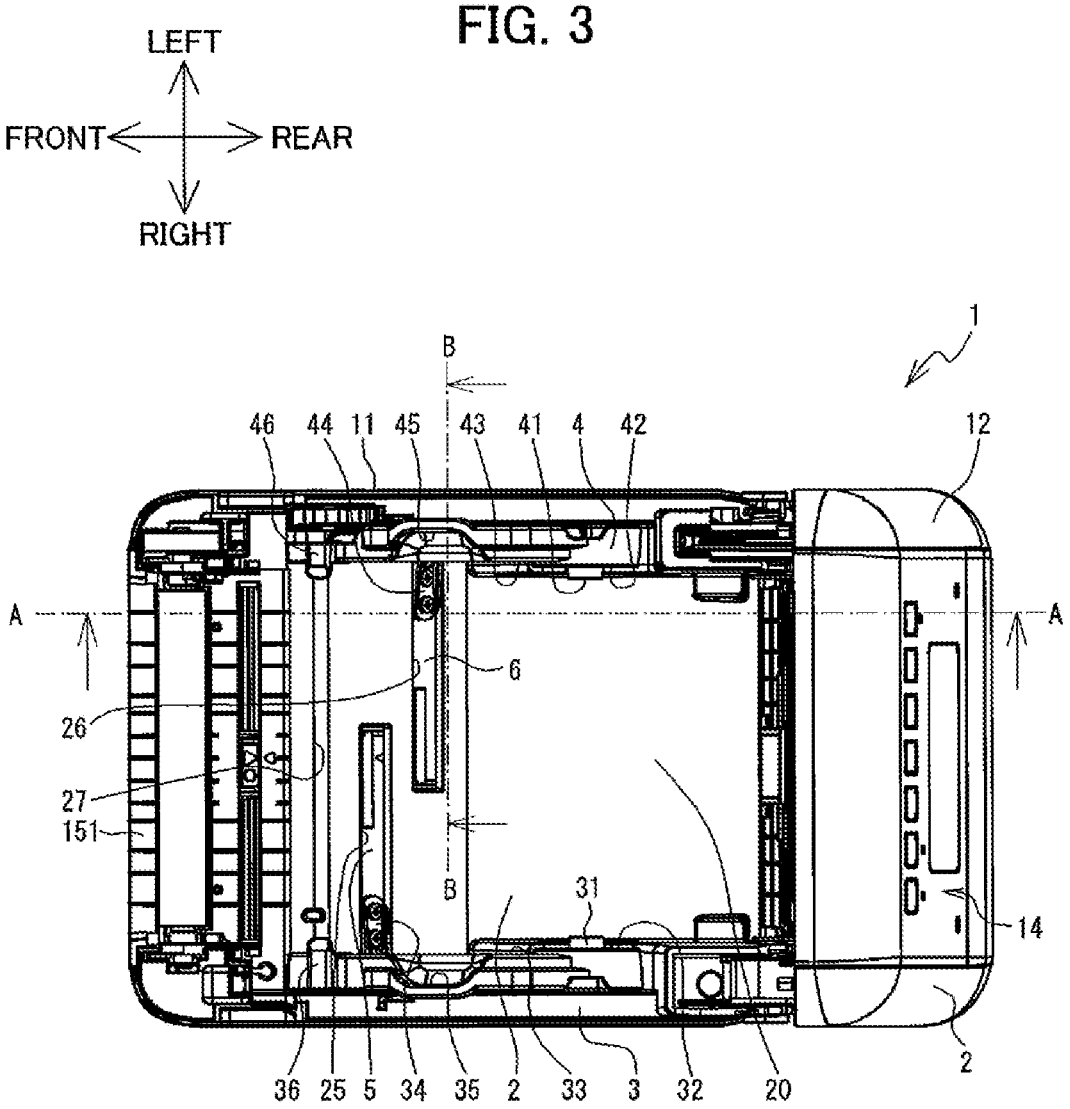
FIG. 3 is a plan view of the printing device according to the embodiment in the opened state of the cover 12 relative to the main body portion 11.

The first support portion 3 is a plate-like member having a generally right-angled triangular shape in a side view. The first support portion 3 includes a protrusion 31, a sector portion 32, a facing surface 33, a connecting portion 34, a concave portion 35, and a convex portion 36 as illustrated in FIGS. 3 and 5. The facing surface 33 faces the facing surface 43 in the separating/approaching direction.

The protrusion 31 having a truncated-cone shape protrudes leftward toward the protrusion 41 from a center of a rear portion of the facing surface 33. That is, the protrusion 31 is aligned with the protrusion 41 in the separating/approaching direction so as to allow the core of the sheet roll M (see FIG. 10) to be fitted with the protrusions 31, 41. The protrusion 31 has a protruding length H from the sector portion 32. This protruding length H is equal to the protruding length H of the protrusion 41 from the sector portion 42.

The sector portion 32 is semicircular shaped, and protrudes in the separating direction (leftward) from the facing surface 33 at a position generally upward of a radial center of the protrusion 31 in the upward/downward direction. The sector portion 32 has an imaginary center generally coincident with the radial center. A length of the protrusion 31 protruding leftward from the facing surface 33 is greater than a length of the sector portion 32 protruding leftward from the facing surface 33.

The connecting portion 34 having a plate-like shape extends in the separating direction (leftward) from a lower-end portion of the facing surface 33. The connecting portion 34 has through-holes extending in the upward/rearward direction. The connecting porting 34 of the first support portion 3 is fixed to a guide member 5 (described later) by screws extending through the through-holes of the connecting portion 34, while the connecting portion 34 is inserted in the guide slot 25 of the main body cover 20. The connecting portion 34 is positioned frontward of the connecting portion 44.

The concave portion 35 is positioned in the vicinity of a hypotenuse of the right angled triangular shaped second support portion 3, and is recessed in the approaching direction (rightward). The convex portion 36 protrudes downward from a front-end portion of the first support portion 3. The convex portion 36 is fitted with the recessed portion 27 of the main body cover 20. Movement of the first support portion 3 in the leftward/rightward direction is guided by the guide slot 25 and the recessed portion 27.

The guide members 5 and 6 are plate-like members having a rectangular shape and extend in the separating/approaching direction. The guide member 5 has a right end portion connected to the connecting portion 34 of the first support portion 3. The guide member 6 has a left end portion connected to the connecting portion 44 of the second support portion 4. The guide members 5 and 6 are positioned below the main cover 20.

As illustrated in FIG. 9, the permission mechanism 40 permits the movable probe 8 to move in accordance with the movement of the second support portion 4 relative to the first support portion 3 in a case where the movement of the second support portion 4 in the separating/approaching direction is within a first range R1. The first range R1 is in a movable range R of the second support portion 4 in the separating/approaching direction. In the first range R1, an interval between the first support portion 3 and the second support portion 4 is not more than a predetermined amount. Further, the permission mechanism 40 prevents the movable probe 8 from moving irrespective of the movement of the second support portion 4 relative to the first support portion 3 in a case where the movement of the second support portion 4 in the separating/approaching direction is within a second range R2. The second range R2 is in the movable range R of the second support portion 4 in the separating/approaching direction. In the second range R2, the interval between the first support portion 3 and the second support portion 4 is greater than the predetermined amount.

The predetermined amount can be set appropriately. For example, the predetermined amount is equal to a maximum widthwise length of the sheet roll M that is accommodatable in the accommodating portion 21. Alternatively, the predetermined amount is a sum of the maximum widthwise length of the sheet roll M and additional predetermined amount such as from 1 to 10 mm, for example. The first range R1 has a length greater than that of the second range R2. The second range R2 has a length greater than the protruding length H of the protrusion 41 from the sector portion 42 in the separating/approaching direction.

The permission mechanism 40 includes the guide member 6, an urging member 7, a protruding portion 64, retaining portions 62 and 63, the rod member 10, and the regulation member 39. The guide member 6, the urging member 7, the protruding portion 64, the retaining portions 62 and 63, and the rod member 10 are positioned below the main body cover 20.

The rod member 10 is fixedly supported to the guide member 6 through the retaining portions 62, 63 and the protruding portion 64. The movable probe 8 is slidably movable along the rod member 10. The urging member 7 is disposed over the rod member 10 and between the retaining portion 63 and the movable probe 8 so as to urge the movable probe 8 in the separating direction (leftward in FIG. 9).

Figure 9A:
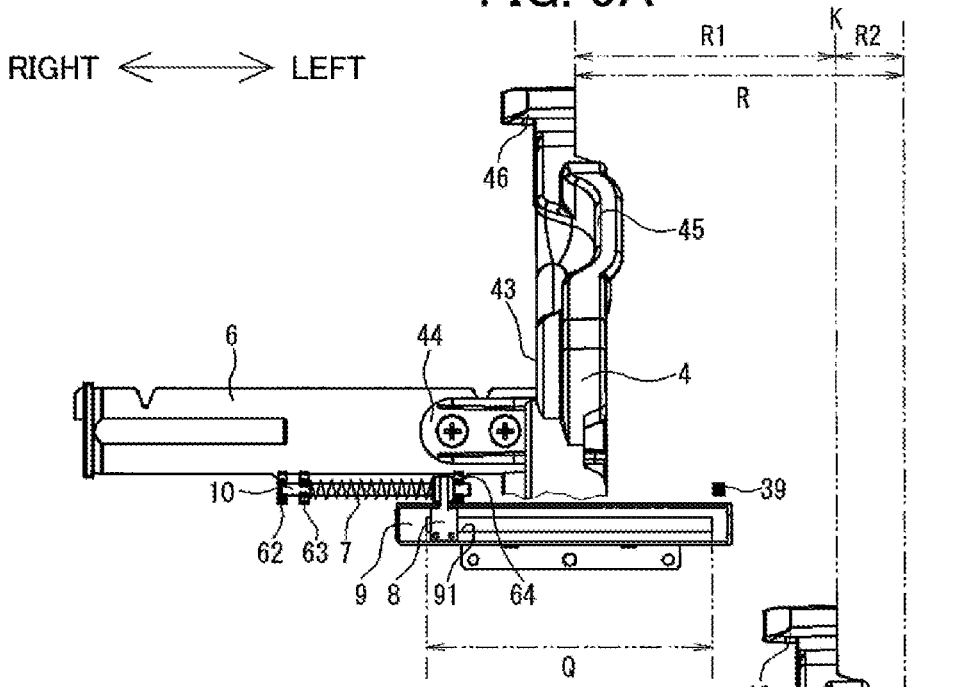
FIG. 9A is a view for description of a movable range R of the second support portion 4, and particularly illustrating a closest position of the second support portion 4 closest to a first support portion 3 in the movable range.
Figure 9B:
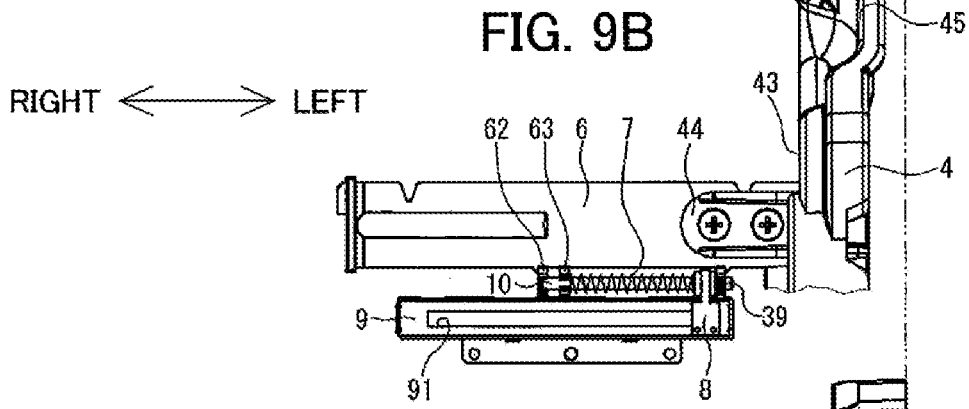
FIG. 9B is a view for description of the movable range R of the second support portion 4, and particularly illustrating a state where the second support portion 4 is positioned at a boundary K in the movable range R.
Figure 9C:
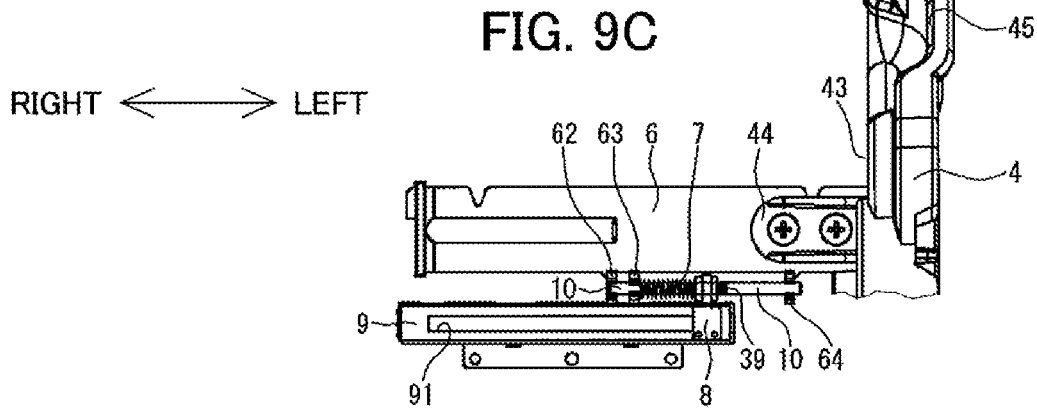
FIG. 9C is a view for description of the movable range R of the second support portion 4, and particularly illustrating a remotest position of the second support portion 4 remotest from the first support portion 3 in the movable range.

More specifically, the urging member 7 is a compression spring wound around the rod member 10 and is positioned between the retaining portion 63 and the movable probe 8 in a compressional state. The protruding portion 64 protrudes from the guide member 6 and at a position leftward of the movable probe 8. The movable probe 8 urged by the urging member 7 in the separating direction is in abutment with the protruding portion 64 in the case where the second support portion 4 is positioned within the first range R1 as illustrated in FIGS. 9A and 9B. The protruding portion 64 is separated from the movable probe 8 in the case where the second support portion 4 is positioned within the second range R2 as illustrated in FIG. 9C.

The retaining portions 62 and 63 are provided at the guide member 6, and are positioned rightward of the protruding portion 64. The retaining portions 62 and 63 and the protruding portion 64 extend from a rear surface of the guide member 6 in the rearward direction. Each of the retaining portions 62 and 63 and the protruding portion 64 includes a receiving portion having a C-shape in a side view with an opening formed on its top.

The rod member 10 is a rod-shaped member extending in the separating/approaching direction, and, specifically, is a shaft having a circle-shape in a side view. The rod member 10 has an outer diameter generally equal to an inner diameter of each of the receiving portions of the retaining portions 62 and 63 and the protruding portion 64. The guide member 6, the retaining portions 62 and 63 and the protruding portion 64 are integrally formed of resin material, and elastically deformable so that each of the openings can be enlarged and shrunk.

The rod member 10 is inserted into the through-hole 83 of the movable probe 8 and is fitted in each of the receiving portions of the retaining portions 62 and 63 and the protruding portion 64. More specifically, the rod member 10 is fitted with the receiving portions of the retaining portions 62 and 63 and the protruding portion 64 in the following manner. The retaining portions 62 and 63 and the protruding portion 64 are elastically deformed so that the openings are enlarged by pressing down the rod member 10 to each top of the retaining portions 62 and 63 and the protruding portion 64. As a result, the rod member 10 passes through the openings. After the rod member 10 moves past the openings, the retaining portions 62 and 63 and the protruding portion 64 elastically deform so that the openings get smaller and the retaining portions 62 and 63 and the protruding portion 64 restore their original shape. Thus, the rod member 10 is retained in the receiving portions and cannot pass through the openings upward.

The rod member 10 has a portion positioned between the retaining portions 62 and 63. The portion has an outer diameter greater than that of a remaining portion of the rod member 10. Therefore, the rod member 10 is not movable in the separating/approaching direction (leftward/rightward direction) relative to the retaining portions 62, 63.

As illustrated in FIGS. 7 and 9, the regulation member 39 prevents the movable probe 8 from moving in the separating/approaching direction in a case where the second support portion 4 moves from the first range R1 to the second range R2. More specifically, the regulation member 39 is a convex portion protruding upward from a lower surface of the main body cover 20. In a case where the second support portion 4 reaches a boundary K between the first range R1 and the second range R2, the movable probe 8 abuts against the regulation member 39, and the regulation member 39 prevents the movable probe 8 from further moving in the separating direction from the boundary K.

As illustrated in FIG. 5, the interlocking mechanism 60 is configured to move the first support portion 3 and the second support portion 4 in the separating/approaching direction in interlocking relation with each other. The interlocking mechanism 60 is positioned below the main body cover 20. The interlocking mechanism 60 includes rack gears 51 and 61, a pinion gear 18, and a supporting plate 70.

The rack gear 51 includes gear teeth provided on a rear surface of the guide member 5. The rack gear 61 includes gear teeth provided on a front surface of the guide member 6 (see FIG. 6). The gear teeth of the rack gear 51 and the rack gear 61 are arrayed in line in the leftward/rightward direction. The rack gears 51 and 61 face each other in the frontward/rearward direction, and the pinion gear 18 is provided therebetween.

The pinion gear 18 is rotatably supported to the supporting plate 70 at a position between the guide slots 25 and 26 in the frontward/rearward direction. The pinion gear 18 is in meshing engagement with the rack gears 51 and 61. The pinion gear 18 is positioned at a center C of a space defined between the first support portion 3 and the second support portion 4 in the separating/approaching direction.

The rack gears 51 and 61 move in the separating/approaching direction and in opposite direction to each other upon rotation of the pinion gear 18. Accordingly, each of the support portions 3 and 4 moves in the separating/approaching direction along the guide slots 25 and 26 and the recessed portion 27 as illustrated in FIG. 3. For example, in a case where the second support portion 4 is moved in the separating direction (leftward direction) by a predetermined amount, the first support portion 3 moves rightward by the predetermined amount in interlocking relation to the movement of the second support portion 4 via the rack gears 51 and 61 and the pinion gear 18. In other words, the rack gears 51 and 61 and the pinion gear 18 make the pair of the support portions 3 and 4 to move apart from each other. On the other hand, in a case where the second support portion 4 is moved in the approaching direction (rightward direction) by a predetermined amount, the first support portion 3 moves leftward by the predetermined amount in interlocking relation to the movement of the second support portion 4 via the rack gears 51 and 61 and the pinion gear 18. In other words, the rack gears 51 and 61 and the pinion gear 18 make the pair of the support portions 3 and 4 to move closer to each other.

The supporting plate 70 is a plate-like member positioned below the pair of the support portions 3 and 4, and extends in the separating/approaching direction. The supporting plate 70 has grooves 79 and 80 extending in the separating/approaching direction at positions facing the guide members 5 and 6, respectively, in the upward/downward direction. The grooves 79 and 80 allow urging members 77 and 78 to be positioned therein, respectively. A tension spring is one of examples of the urging members 77 and 78. The urging member 77 has a right end portion engaged with the supporting plate 70, and has a left end portion engaged with a lower end portion of the second support portion 4. The urging member 78 has a left end portion engaged with the supporting plate 70, and has a right end portion engaged with a lower end portion of the first support portion 3. The urging members 77 and 78 urge the pair of the support portions 3 and 4 toward the center C to move closer to each other.

3. Operation Mode of Roll Support Mechanism 23

Figure 10:
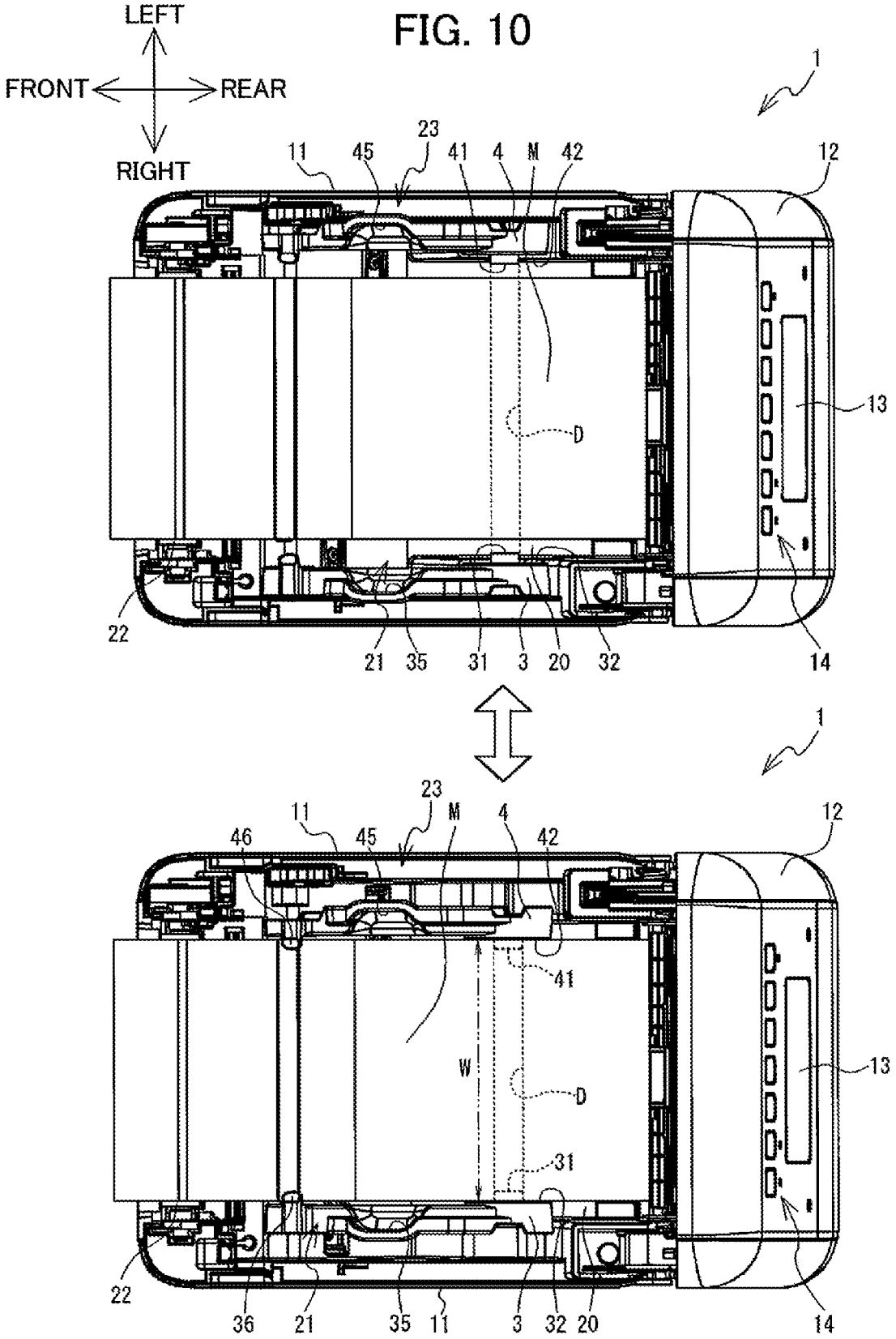
FIG. 10 is a view for description of a procedure of placing a sheet roll M to the printing device 1.

A user's operation for attaching the sheet roll M to the accommodating portion 21 of the printing device 1 will be described with reference to FIGS. 3, 9 and 10.

The user opens the cover 12. In the opened state of the cover 12 (illustrated in FIG. 3), the user pushes a part of the first support portion 3 and the second support portion 4 such as the concave portion 35 or the concave portion 45 rightward or leftward, respectively, to move the pair of the support portions 3 and 4 apart from each other. The urging member 7 has an urging force to urge the movable probe 8 in the separating direction so that abutment between the movable probe 8 and the protruding portion 64 is maintained in the case where the second support portion 4 is positioned within the first range R1.

In a case where the user attaches a sheet roll M having a largest widthwise length width among various sizes of sheet rolls, the user moves the second support portion 4 to a position within the second range R2. The movable probe 8 urged by the urging member 7 in the separating direction is in abutment with the protruding portion 64 and moves in the separating/approaching direction in interlocking relation to the movement of the second support portion 4 in the case where the second support portion 4 is positioned within the first range R1 as illustrated in FIG. 9A.

In the case where the second support portion 4 reaches a boundary K between the first range R1 and the second range R2 as illustrated in 9B, the intervening member 81 of the movable probe 8 abuts against the regulation member 39, but the intervening member 81 and the movable body 82 maintain engagement with each other. Thus, the regulation member 39 prevents the movable probe 8 from further moving in the separating direction, while the abutment between the intervening member 81 of the movable probe 8 and the regulation member 39 is maintained. In the case where the second support portion 4 is positioned within the second range R2, the movable probe 8 is maintained at the abutment position in abutment with the regulation member 39 irrespective of further movement of the second support portion 4 in the separating direction. Thus, as illustrated in FIG. 9C, the protruding portion 64 is separated from the movable probe 8, and the urging member 7 is more compressed so that a length of the urging member 7 becomes smaller. More specifically, in the case where the second support portion 4 is positioned within the second range R2, the user moves the support portion 4 in the separating direction against the urging force of the urging member 7. Thus, a load required to move the second support portion 4 and the guide portion 6 in the separating direction is greater than the urging force of the urging member 7.

The movable probe 8 has a movable range having a length equal to that of the first range R1 in the separating/approaching direction. In addition, the detector 9 has a detectable range Q which is defined by the length of the guide groove 91 in the separating/approaching direction. Additional space is provided in the guide groove 91 to absorb dimensional errors and assembly errors of mechanical parts. Thus, the length of the movable range of the movable probe 8 is generally equal to or slightly smaller than the length of the detectable range Q in the separating/approaching direction. Further, the length of the detectable range Q is smaller than the length of the movable range R of the second support portion 4 in the separating/approaching direction.

The user moves the support portions 3 and 4 in a direction opposite to each other against biasing force of the urging members 77 and 78 to position the sheet roll M at a position between the support portions 3 and 4 as illustrated in FIG. 10A such that the tape of the roll M is wound over the core of the sheet roll M in a clockwise manner in a right side view. Then, the user releases the support portions 3 and 4 so that the support portions 3 and 4 are moved toward each other by the biasing force of the urging members 77 and 78 until the sector portions 32 and 42 abut against the sheet roll M as illustrated in FIG. 10B. The support portions 3 and 4 stop moving within the first range R1 upon contact of the sector portions 32 and 42 with the sheet roll M. In this case, the protrusions 31 and 41 are fitted within the through-hole D of the core of the sheet roll M. As a result, a distance between the sector portions 32 and 42 becomes approximately equal to a widthwise length W of the sheet roll M.

The detector 9 can output detection signal indicative of the widthwise length of the sheet roll M in accordance with a position of the second support portion 4 in the separating/approaching direction. A portion of the tape pulled out of the sheet roll M is positioned along the arcuate-shaped upper surface of the main body cover 20. A front-end portion of the tape is positioned in the vicinity of the ejection portion 15. Further, the main body cover 20 and the convex portions 46 and 36 nips the tape in the leftward/rightward direction to define a conveying passage of the tape. Then the user closes the cover 12. The user can also detach the sheet roll M out of the accommodating portion 21 in a similar manner.

4. Printing Operation

In operation, the user opens the cover 12 to attach or detach the sheet roll M to or from the accommodating portion 21. The sheet roll M accommodated in the accommodating portion 21 has the width extending in the leftward/rightward direction. In the closed state of the cover 12, the thermal head 30 is positioned in the vicinity of the platen roller 22. In a case where a portion of the tape is positioned between the thermal head 30 and the platen roller 22, the platen roller 22 presses the portion of the tape toward the thermal head 30.

A conveying motor (not illustrated) is provided for rotating the platen roller 22. Rotation of the platen roller 22 pays out the tape from the sheet roll M and conveys the tape while the tape is pressed between the platen roller 22 and the thermal head 30. In the thermal head 30, a plurality of heating elements selectively generate heat, to thus print a character image line-by-line basis on the heat sensitive label affixed to the base sheet of the tape. In the closed state of the cover 12, the tape having the heat sensitive label on which the character image is printed is ejected from the ejection portion 15 to an outside of the printing device 1. The printing device 1 may be provided with a cutter for cutting the printed tape at a predetermined position.

In the printing device 1 according to the above-mentioned embodiment, the movable probe 8 can move in the separating/approaching direction in interlocking relation to the movement of the second support portion 4 in the case where the second support portion 4 is positioned within the first range R1. Therefore, the detector 9 can detect a width of the printing medium according to a position of the movable probe 8, the position being in accordance with the position of the second support portion 4.

Further, the user can move the second support portion 4 from the first range R1 to the second range R2 so as to position the sheet roll M at a position between the first support portion 3 and the second support portion 4 while preventing the movable probe 8 from further moving to the second range R2. Hence, the movable range R of the second support portion 4 has a length greater than that of the movable range of the movable probe 8. Therefore, setting of the sheet roll M in the sheet accommodating portion 21 can be facilitated, and such facilitation can be realized without prolongation of moving range of the movable probe 8.

The movable range of the movable probe 8, which is slidably supported by the detector 9, is determined in accordance with the maximum widthwise length of the sheet roll M accommodatable in the accommodating portion 21. Further, the detectable range Q of the detector 9 is determined so that a position of the movable probe 8 in accordance with the maximum widthwise length of the sheet roll M is in the vicinity of an end portion of the detectable range Q in the separating direction. As a result, the detectable range Q of the detector 9 can be efficiently utilized.

On the other hand, in the printing device 1, the protrusions 31 and 41 are fitted within the through-hole D of the core of the sheet roll M, and the sector portions 32 and 42 are in abutment with the sheet roll M so as to retain the sheet roll M. Therefore, for attaching or detaching the sheet roll M to or from the accommodating portion 21 of the printing device 1, the user needs to move each of the support portions 3 and 4 by at least the protruding length H (2H in total) further from the sheet roll retaining position of the first and second support portions 3 and 4. Such further movement of each of the support portions 3 and 4 by the protruding length H is only required for performing attaching or detaching the sheet roll M to or from the accommodating portion 21 of the printing device 1. In this case, detection of the widthwise length of the sheet roll M is not required. Therefore, setting of the sheet roll M can be facilitated through the permission mechanism 40, and such facilitation can be realized without prolongation of the detector 9 in the leftward/rightward direction.

The printing device 1 according to the present disclosure is not limited to the above-mentioned embodiment, and various modifications may be made therein without departing from the spirit of the disclosure. For example, the following modifications (1)-(4) may be conceivable.

(1) The members or components of the printing device 1 may be modified in shapes, materials, and positions. For example, the first support portion 3 and the second support portion 4 may have a modified configuration. Each of the sector portions 32 and 42 may be replaced by a disk-shaped member or may be omitted. For example, the first support portion 3 is unmovable, and the second support portion 4 is sliadbly movable against an urging force of a tension spring. Each of the first support portion 3 and the second support portion 4 may be formed of a metal material or various kinds of materials instead of a resin material. Position of the second support portion 4 relative to the first support portion 3 may be modified. Only one of the second support portion 4 may be movable in the separating/approaching direction relative to the first support portion 3. The printing mode of the printing device 1 may be appropriately modified. For example, the present disclosure may be applied to an ink ribbon printer or an inkjet printer.

(2) All or part of the members of the permission mechanism 40 such as the guide member 6, the urging member 7, the protruding portion 64, the retaining portions 62 and 63, the rod member 10, and the regulation member 39 may have a modified configuration. For example, the urging member 7 may be a tension spring positioned for urging the movable probe 8 in the separating direction. The guide member 6 may be integral with the second support portion 4. The protruding portion 64 and the retaining portions 62 and 63 may be provided at a front surface, an upper surface, or a bottom surface of the guide member 6. The regulation member 39 may be fixed to at least one of the supporting plate 70 and the detector 9.

(3) The moving probe 8 may not have the through-hole 83 extending in the separating/approaching direction. Further, the intervening member 81 and the movable body 82 of the movable probe 8 may be integral with each other. The regulation member 39 may be provided at a portion other than the main body cover 20 such as at the guide member 6 and the supporting plate 70.

(4) In the printing device 1, the interlocking mechanism 60 may have an appropriately modified configuration, or may be omitted. The distance between the first support portion 3 and the second support portion 4 may be adjustable through a mechanism other than the rack gears 51 and 61. In the interlocking mechanism 60, at least one of the urging members 77 and 78 may have an appropriately modified configuration, or may be omitted.

What is claimed is:

1. A printing device comprising:

a first support portion;

a second support portion detachably supporting a rolled printing medium in cooperation with the first support portion, the second support portion being configured to be movable in a movable range in a separating/approaching direction which is a moving direction of the second support portion toward and away from the first support portion, the movable range consisting of a first range and a second range following the first range, an interval between the first support portion and the second support portion being not more than a predetermined amount in the first range, and the interval between the first support portion and the second support portion being greater than the predetermined amount in the second range;

a movable probe movable in the separating/approaching direction;

a detector positioned at a fixed position and supporting the movable probe, the detector being of a contact type and configured to detect a position of the movable probe in the separating/approaching direction in a state that the detector is in contact with the movable probe, the detector providing a detectable range ranging within the first range; and a permission mechanism configured to permit the movable probe to move in the detectable range in accordance with the movement of the second support portion in the separating/approaching direction relative to the first support portion in a case where the movement of the second support portion is within the first range, the permission mechanism being also configured to prevent the movable probe from moving irrespective of further movement of the second support portion relative to the first support portion in a case where the movement of the second support portion in the separating/approaching direction is within the second range.

2. A printing device comprising:

a first support portion;

a second support portion detachably supporting a rolled printing medium in cooperation with the first support portion, the second support portion being configured to be movable in a movable range in a separating/approaching direction which is a moving direction of the second support portion toward and away from the first support portion, the movable range consisting of a first range and a second range following the first range, an interval between the first support portion and the second support portion being not more than a predetermined amount in the first range, and the interval between the first support portion and the second support portion being greater than the predetermined amount in the second range;

a movable probe movable in the separating/approaching direction;

a detector positioned at a fixed position and supporting the movable probe and configured to detect a position of the movable probe in the separating/approaching direction, the detector providing a detectable range ranging within the first range; and a permission mechanism configured to permit the movable probe to move in accordance with the movement of the second support portion in the separating/approaching direction relative to the first support portion in a case where the movement of the second support portion is within the first range, the permission mechanism being also configured to prevent the movable probe from moving irrespective of further movement of the second support portion relative to the first support portion in a case where the movement of the second support portion in the separating/approaching direction is within the second range;

wherein the permission mechanism comprises:

a guide member extending from the second portion in an approaching direction which is a direction from the second support portion toward the first support portion;

an urging member supported to the guide member and urging the movable probe in a separating direction which is a direction from the first support portion toward the second support portion; and a protruding portion provided at the guide member and positioned forward of the movable probe in the separating direction, the movable probe being in abutment with the protruding portion in the case where the second support portion is positioned within the first range, and the movable probe being separated from the protruding portion in the case where the second support portion is positioned within the second range.

3. The printing device according to claim 2, wherein the movable probe is formed with a through-hole extending in the separating/approaching direction;

wherein the permission mechanism further comprises:

a retaining portion provided at the guide member and positioned forward of the protruding portion in the approaching direction;

a rod member extending in the separating/approaching direction and supported by the retaining portion and the protruding portion, the rod member extending through the through-hole such that the movable probe is movable relative to the rod member; and a regulation member configured to prevent the movable probe from moving in the separating direction in a case where the second support member is moved from the first range to the second range.

4. The printing device according to claim 3, wherein the urging member is a coil spring disposed over the rod member and interposed between the retaining portion and the movable probe in a compressed fashion.

5. The printing device according to claim 4, wherein the regulation member is immovably positioned so as to abut against the movable probe at a position downstream of the movable probe in the separating direction.

6. The printing device according to claim 5, wherein the regulation member is a convex portion.

7. The printing device according to claim 4, wherein the retaining portion comprises a first retaining portion, and a second retaining portion arrayed with the first retaining portion in the separating/approaching direction, the first retaining portion and the second retaining portion extending from the guide member and having inner diameters;

wherein the rod member has a specific portion between the first retaining portion and the second retaining portion, and a remaining portion, the remaining portion having an outer diameter equal to the inner diameters, and the specific portion having an outer diameter greater than the inner diameters, avoiding displacement of the rod member in the separating/approaching direction relative to the first retaining portion and the second retaining portion.

8. The printing device according to claim 1, further comprising an interlocking mechanism configured to move the first support portion and the second support portion in the separating/approaching direction in interlocking relation to each other.

9. The printing device according to claim 8, wherein the interlocking mechanism comprises a pair of rack gears and a pinion gear.

10. A printing device comprising:

a first support portion;

a second support portion detachably supporting a rolled printing medium in cooperation with the first support portion, the second support portion being configured to be movable in a movable range in a separating/approaching direction which is a moving direction of the second support portion toward and away from the first support portion, the movable range consisting of a first range and a second range following the first range, an interval between the first support portion and the second support portion being not more than a predetermined amount in the first range, and the interval between the first support portion and the second support portion being greater than the predetermined amount in the second range;

a movable probe movable in the separating/approaching direction;

a detector positioned at a fixed position and supporting the movable probe and configured to detect a position of the movable probe in the separating/approaching direction, the detector providing a detectable range ranging within the first range; and a permission mechanism configured to permit the movable probe to move in accordance with the movement of the second support portion in the separating/approaching direction relative to the first support portion in a case where the movement of the second support portion is within the first range, the permission mechanism being also configured to prevent the movable probe from moving irrespective of further movement of the second support portion relative to the first support portion in a case where the movement of the second support portion in the separating/approaching direction is within the second range, wherein the predetermined amount is equal to a maximum widthwise length of the rolled printing medium.

11. A printing device comprising:

a first support portion;

a second support portion detachably supporting a rolled printing medium in cooperation with the first support portion, the second support portion being configured to be movable in a movable range in a separating/approaching direction which is a moving direction of the second support portion toward and away from the first support portion, the movable range consisting of a first range and a second range following the first range, an interval between the first support portion and the second support portion being not more than a predetermined amount in the first range, and the interval between the first support portion and the second support portion being greater than the predetermined amount in the second range;

a movable probe movable in the separating/approaching direction;

a detector positioned at a fixed position and supporting the movable probe and configured to detect a position of the movable probe in the separating/approaching direction, the detector providing a detectable range ranging within the first range; and a permission mechanism configured to permit the movable probe to move in accordance with the movement of the second support portion in the separating/approaching direction relative to the first support portion in a case where the movement of the second support portion is within the first range, the permission mechanism being also configured to prevent the movable probe from moving irrespective of further movement of the second support portion relative to the first support portion in a case where the movement of the second support portion in the separating/approaching direction is within the second range, the permission mechanism including a regulation member positioned at a fixed position in the separating/approaching direction such that the movable probe that moves in accordance with the movement of the second support portion contacts the regulation member when the second support portion is moved from the first range to the second range, thereby being prevented from moving further in the separating direction.

* * * * *